US006419153B1

(12) United States Patent
Maita

(10) Patent No.: US 6,419,153 B1
(45) Date of Patent: Jul. 16, 2002

(54) COMBINATION FOOD CONTAINER AND SEALED CONDIMENT DISPENSER

(76) Inventor: Ronald Maita, 10105 E. Via Linda, Suite103-153, Scottsdale, AZ (US) 85258

( * ) Notice: Subject to any disclaimer, the term of this patent is extended or adjusted under 35 U.S.C. 154(b) by 0 days.

(21) Appl. No.: 09/542,701

(22) Filed: Apr. 3, 2000

(51) Int. Cl.[7] ..... B65D 21/024

(52) U.S. Cl. ..... 229/400; 220/23.4; 229/123.2; 229/906

(58) Field of Search ..... 229/123.2, 400, 229/902, 904, 906; 206/541; 220/23.4, 23.83, 23.86; 426/115, 122

(56) References Cited

U.S. PATENT DOCUMENTS

| | | | | | |
|---|---|---|---|---|---|
| 2,647,681 | A | | 8/1953 | Paoli | |
| 2,794,545 | A | | 6/1957 | Olson | |
| 3,442,435 | A | | 5/1969 | Ludder et al. | |
| 3,920,120 | A | * | 11/1975 | Shveda | 229/400 |
| 4,126,261 | A | | 11/1978 | Cook | |
| 4,209,126 | A | * | 6/1980 | Elias | 229/123.2 |
| 4,232,787 | A | * | 11/1980 | Holiday | 229/123.2 |
| 4,596,713 | A | | 6/1986 | Burdette | |
| 4,854,466 | A | | 8/1989 | Lane, Jr. | |
| 5,147,337 | A | | 9/1992 | Plone | |
| 5,429,262 | A | * | 7/1995 | Sharkey | 220/23.4 |
| 5,540,333 | A | | 7/1996 | Gorzalez et al. | |
| 5,630,544 | A | | 5/1997 | Shane | |
| 5,676,990 | A | * | 10/1997 | Wawrzynski | 426/115 |
| 5,720,429 | A | | 2/1998 | Cordle | |
| 5,799,794 | A | | 9/1998 | Whitnell | |
| 5,842,631 | A | | 12/1998 | Berger | |
| 5,875,957 | A | | 3/1999 | Yocum | |
| 6,062,468 | A | * | 5/2000 | Tausanovitch | 229/400 |
| 6,076,700 | A | * | 6/2000 | Manges | 220/23.4 |
| 6,182,890 | B1 | * | 2/2001 | Sattler et al. | 229/400 |
| 6,230,969 | B1 | * | 5/2001 | Spransy | 229/400 |

* cited by examiner

*Primary Examiner*—Gary E. Elkins
(74) *Attorney, Agent, or Firm*—Jeffrey Weiss; Harry M. Weiss; Weiss & Moy, P.C.

(57) ABSTRACT

A combination food container and sealed condiment dispenser, in which a sealed condiment dispenser is fixedly attached to a food container dimensioned to house a finger food.

1 Claim, 1 Drawing Sheet

COMBINATION FOOD CONTAINER AND SEALED CONDIMENT DISPENSER

FIELD OF THE INVENTION

This invention relates generally to food containers and, more specifically, to a combination food container and sealed condiment dispenser and method therefor.

BACKGROUND OF THE INVENTION

Food containers are often utilized in the fast food industry to hold varying food products such as french fries, onion rings, chicken nuggets, and the like. Many individuals prefer to eat these foods, generally referred to as finger foods, after applying a condiment, such as ketchup, mustard, barbecue sauce, etc. These condiments are acquired separately from the finger food, and subsequently applied to the finger food. The condiments are usually provided in either a sealed condiment package, or in a cup-like condiment container. Condiments that are transported in an unsealed package or open container are, of course, prone to spilling. Even sealed condiment packages, if not fixedly attached to the food container, can be dropped, also creating a hazard, as well as inconveniencing the individual. Moreover, with any condiment package that is not fixedly attached to the food container, there is a danger that the customer will leave the establishment where the finger food was purchased, forget to obtain the condiment, and then find himself or herself away from the eating establishment without having a condiment handy.

Prior art attempts to combine a condiment with a food container do not provide a sealed condiment package fixedly attached to a food container. For example, U.S. Pat. No. 5,540,333 issued to Gonzalez et al. shows a food container with an open, unsealed container for ketchup. Other food containers, although providing a sealed condiment package, do not show the sealed condiment package fixedly connected to the food container. For example, U.S. Pat. No. 3,442,435 issued to Ludder et al. and U.S. Pat. No. 4,854,466 issued to Lane, Jr. show condiment packages which hang on the lip of the food container.

A need therefore existed for a food container with a sealed condiment dispenser fixedly connected to a part of the container to allow for the quick, clean, convenient, and safe application of a condiment to a food.

SUMMARY OF THE INVENTION

An object of the present invention is to provide a combination food container and sealed condiment dispenser with the condiment dispenser fixedly connected to the food container to allow for safe and easy application of a condiment to food.

It is a further object of the present invention to provide a method for dispensing a condiment from a combination food container and sealed condiment dispenser.

BRIEF DESCRIPTION OF THE PREFERRED EMBODIMENTS

In accordance with one embodiment of the present invention, a combination food container and sealed condiment dispenser comprising, in combination, a food container having a front portion, a back portion, a bottom portion joining a bottom end of the front portion and a bottom end of the back portion, a first side portion joining a first side end of the back portion and a first side end of the front portion, and a second side portion joining a second side end of the back portion and a second side end of the front portion, and a sealed condiment package fixedly attached to one of the front portion, the back portion, the first side portion, and the second side portion.

In accordance with another embodiment of the present invention, a method for dispensing a condiment from a combination food container and sealed condiment dispenser, comprising the steps of providing a food container having a front portion, a back portion, a bottom portion joining a bottom end of the front portion and a bottom end of the back portion, a first side portion joining a first side end of the back portion and a first side end of the front portion, and a second side portion joining a second side end of the back portion and a second side end of the front portion, providing a sealed condiment package, fixedly attaching the condiment package to one of the front portion, the back portion, the first side portion, and the second side portion, providing a quick opening mechanism on the sealed condiment package, and engaging the quick opening mechanism to release contents of the sealed condiment package.

The foregoing and other objects, features, and advantages of the invention will be apparent from the following, more particular description of the preferred embodiments of the invention, as illustrated in the accompanying drawings.

DETAILED DESCRIPTION OF THE PREFERRED EMBODIMENTS

Figure 1:
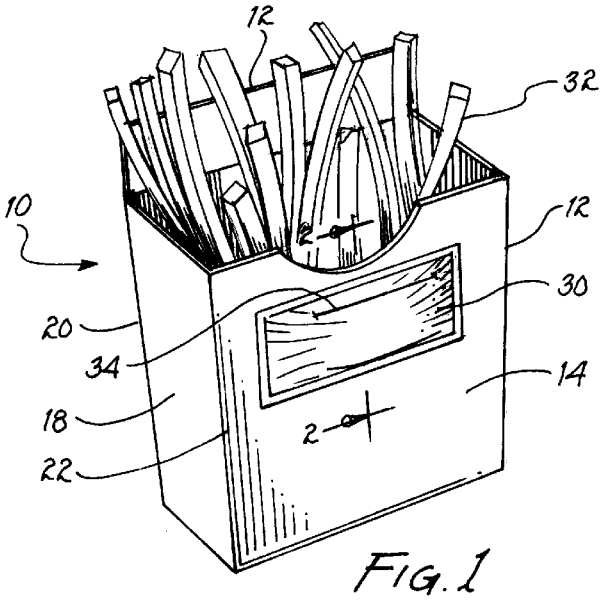
FIG. 1 is a perspective view of an embodiment of the combination food container and sealed condiment dispenser of the present invention wherein the sealed condiment dispenser is attached to the front side of the front portion.
Figure 3:
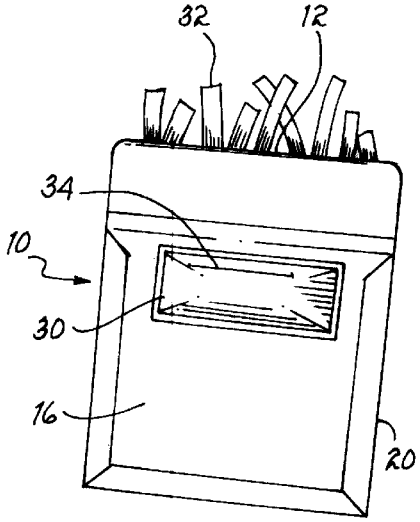
FIG. 3 is a back view of another embodiment of the combination food container and sealed condiment dispenser of the present invention wherein the sealed condiment dispenser is attached to the back side of the back portion.

Referring to FIGS. 1, 3, 4, and 5, reference number 10 refers generally to the combination food container and sealed condiment dispenser of the present invention. The combination food container and sealed condiment dispenser 10 generally comprises a food container 12. The food container 12 has a front portion 14 (also shown in FIG. 2) and a back portion 16 (shown only in FIG. 3). A bottom portion (not shown), joins a bottom end of the front portion 14 and a bottom end of the back portion 16.

Figure 2:
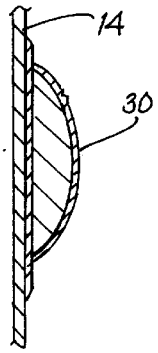
FIG. 2 is a side cross-sectional view of the front portion of the combination food container and sealed condiment dispenser of FIG. 1, taken along line 2—2.

Now referring to FIG. 1, the combination food container and sealed condiment dispenser 10 further comprises a first side portion 18. The first side portion 18 joins a first side end 20 of the back portion 16 and a first side end 22 of the front portion 14.

Figure 4:
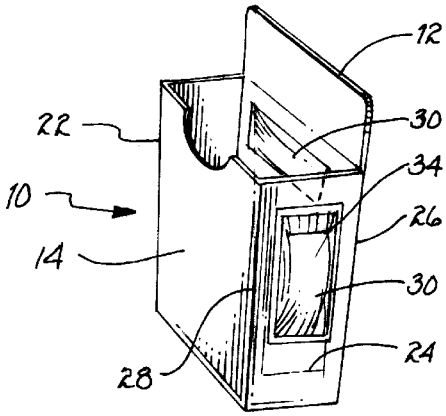
FIG. 4 is a perspective view of another embodiment of the combination food container and sealed condiment dispenser of the present invention, wherein a sealed condiment dispenser is attached to the second side portion and a sealed condiment dispenser is attached to the front side of the back portion.
Figure 5:
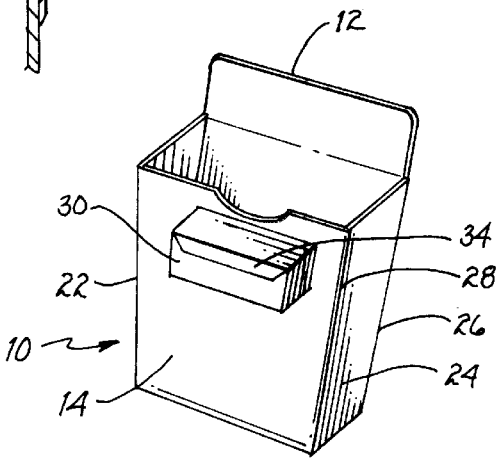
FIG. 5 is a perspective view of another embodiment of the combination food container and sealed condiment dispenser of the present invention wherein the sealed condiment dispenser is attached to the front side of the front portion.

Referring now to FIGS. 4 and 5, the combination food container and sealed condiment dispenser 10 further comprises a second side portion 24. The second side portion 24 joins a second side end 26 of the back portion 16 and a second side end 28 of the front portion 14. In combination, the configuration of the front portion 14, back portion 16, bottom portion, first side portion 18, and second side portion 24 define a cavity in which a finger food 32, such as french fries, onion rings, chicken nuggets and the like, can be retained. While, in the preferred embodiment, the food container 12 comprises a substantially rectangular shape, it should be understood that substantial benefit could be derived from a food container 12 of any shape sufficient to retain a finger food 32.

Referring now to FIGS. 1–5, the combination food container and sealed condiment dispenser 10 further comprises at least one sealed condiment dispenser 30. The sealed condiment dispenser 30 contains a condiment such as ketchup, mustard, salsa, and the like. These particular condiments are exemplary only, and the term "condiment" as used herein shall mean any food item capable of being contained within a condiment dispenser and consumed with any finger-type food. The sealed condiment dispenser 30 is fixedly attached to at least one of the front portion 14, the back portion 16, the first side portion 18, and the second side portion 24 using any means sufficient to provide a secure seal, including heat-seal adhesives, pressure-seal adhesives, or any other adhesive format. In the preferred embodiment, one sealed condiment dispenser 30 is fixedly attached to an exterior surface of the front portion 14, however it should be clearly understood that substantial benefit could be derived from any of the alternative embodiments in which the sealed condiment dispenser 30 is fixedly attached to at least one of the interior surface and exterior surface of the back portion 16, the first side portion 18, and the second side portion 24.

Referring now to FIGS. 1, 3, 4, and 5, the sealed condiment dispenser 30 preferably comprises a quick opening mechanism 34, such as a tear strip, peel-off strip or any other convenient opening mechanism, so that the sealed condiment dispenser 30 can be readily opened without inadvertently separating it from the food container. Once the sealed condiment dispenser 30 is opened, the finger food can be dipped therein or, if the sealed condiment dispenser 30 is located within the food container, the contents of the sealed condiment dispenser can be dispensed into the food container. As a further alternative, the sealed condiment dispenser 30 can be forcibly removed from the food container, and thereafter applied to the finger food as desired.

While the invention has been particularly shown and described with reference to preferred embodiments thereof, it will be understood by those skilled in the art that the foregoing and other changes in form and details may be made therein without departing from the spirit and scope of the invention.

What is claimed is:

1. A combination food container and sealed condiment dispenser comprising, in combination:

a food container having an opening at an upper portion thereof and wherein said opening is circumscribed by a rim; and at least one rectangular condiment package having a front rectangular face and a flat back rectangular portion and having an entire surface of said flat back rectangular portion in contact with a surface of said food container below an exposed upper surface of said rim;

wherein said front rectangular face tapers along each side thereof to contact corresponding sides of said flat back rectangular portion; and sealing means for creating an elongated opening in said front rectangular face of said sealed condiment package along an upper long side of said front rectangular face proximate a corresponding upper long side of said flat back rectangular portion.

* * * * *